US011186973B2

(12) United States Patent
Rosko et al.

(10) Patent No.: US 11,186,973 B2
(45) Date of Patent: Nov. 30, 2021

(54) CANTILEVERED FAUCET SPOUT

(71) Applicant: Delta Faucet Company, Indianapolis, IN (US)

(72) Inventors: Michael Scot Rosko, Greenwood, IN (US); Thad J. Eads, Urbana, IN (US)

(73) Assignee: Delta Faucet Company, Indianapolis, IN (US)

( * ) Notice: Subject to any disclaimer, the term of this patent is extended or adjusted under 35 U.S.C. 154(b) by 25 days.

(21) Appl. No.: 16/235,563

(22) Filed: Dec. 28, 2018

(65) Prior Publication Data

US 2020/0208383 A1 Jul. 2, 2020

(51) Int. Cl.
*E03C 1/04* (2006.01)

(52) U.S. Cl.
CPC ..... *E03C 1/0404* (2013.01); *E03C 1/04* (2013.01); *E03C 1/0407* (2013.01); *Y10T 137/9464* (2015.04)

(58) Field of Classification Search
CPC ..... Y10T 137/9464; F16K 19/006; E03C 1/0404; E03C 1/0407; E03C 1/04
See application file for complete search history.

(56) References Cited

U.S. PATENT DOCUMENTS

| | | | | |
|---|---|---|---|---|
| 2,367,809 | A | 1/1945 | Stein et al. | |
| 3,034,536 | A | 5/1962 | Kennison | |
| 3,448,768 | A | 6/1969 | Keller | |
| D294,631 | S | 3/1988 | Bourbon | |
| D304,225 | S | 10/1989 | Lathrop | |
| 4,884,596 | A | 12/1989 | Byers et al. | |
| 4,889,165 | A * | 12/1989 | Newcombe | E03C 1/04 137/801 |
| 4,894,874 | A | 1/1990 | Wilson | |
| 4,946,135 | A | 8/1990 | Yang | |
| 5,579,808 | A | 12/1996 | Mikol et al. | |
| 6,817,379 | B2 | 11/2004 | Perla | |
| 6,832,032 | B2 | 12/2004 | Simmons et al. | |
| 6,926,035 | B2 | 8/2005 | Ozagir | |
| 7,445,024 | B2 | 11/2008 | Paterson et al. | |

(Continued)

FOREIGN PATENT DOCUMENTS

| | | |
|---|---|---|
| CN | 201483841 | 5/2010 |
| CN | 104191520 | 1/2017 |

(Continued)

OTHER PUBLICATIONS

Bar Faucet with Angled Spout and Knurled Handle; retrieved on Mar. 7, 2018 from https://www.brizo.com/kitchen/product/61063LF-PC, 8 pgs.

(Continued)

*Primary Examiner* — Marina A Tietjen
*Assistant Examiner* — Frederick D Soski
(74) *Attorney, Agent, or Firm* — Bose McKinney & Evans LLP

(57) ABSTRACT

A faucet assembly including a spout with two fluid channels spaced apart from one another by a void. In an illustrative embodiment, the fluid channels converge near at least one outlet of the faucet assembly to create a desired flow pattern (e.g., waterfall flow) when the water source is operational and fluidly coupled to the faucet assembly. In an illustrative embodiment, the faucet spout is formed through additive manufacturing.

25 Claims, 8 Drawing Sheets

(56) References Cited

U.S. PATENT DOCUMENTS

| | | | | |
|---|---|---|---|---|
| 7,766,043 | B2 | 8/2010 | Thomas | |
| 8,061,142 | B2 | 11/2011 | Kastrup et al. | |
| 8,739,826 | B2 | 6/2014 | Thomas | |
| 8,820,705 | B2 | 9/2014 | Davidson et al. | |
| D731,042 | S * | 6/2015 | Fritz | D23/304 |
| D735,298 | S * | 7/2015 | Eads | D23/238 |
| 9,096,002 | B2 | 8/2015 | Seman, Sr. | |
| D737,941 | S * | 9/2015 | Eads | D23/255 |
| D751,173 | S * | 3/2016 | Bahler | D23/213 |
| D751,667 | S * | 3/2016 | Bahler | D23/213 |
| D757,912 | S * | 5/2016 | Eads | D23/255 |
| D759,205 | S * | 6/2016 | Eads | D23/238 |
| D759,212 | S * | 6/2016 | Eads | D23/255 |
| D767,725 | S * | 9/2016 | Eads | D23/238 |
| D769,419 | S * | 10/2016 | Eads | D23/242 |
| 9,573,191 | B2 | 2/2017 | Jagtap et al. | |
| 9,671,259 | B2 | 6/2017 | Potter | |
| 9,695,579 | B2 | 7/2017 | Herbert et al. | |
| D798,420 | S * | 9/2017 | Eads | D23/255 |
| D852,326 | S | 6/2019 | Mckeone | |
| 2003/0183275 | A1 | 10/2003 | Yang | |
| 2005/0103389 | A1 | 5/2005 | Wei | |
| 2005/0223490 | A1 | 10/2005 | Kunkel | |
| 2006/0101575 | A1 | 5/2006 | Louis | |
| 2006/0117476 | A1 | 6/2006 | Kunkel | |
| 2006/0118188 | A1 | 6/2006 | Hsu | |
| 2006/0144442 | A1 | 7/2006 | Lehner | |
| 2006/0254650 | A1 | 11/2006 | Wu et al. | |
| 2006/0266424 | A1 | 11/2006 | Fitness | |
| 2007/0232108 | A1 | 10/2007 | Miura et al. | |
| 2008/0277927 | A1 | 11/2008 | Mueller et al. | |
| 2009/0016156 | A1 | 1/2009 | Wu et al. | |
| 2009/0242671 | A1 | 10/2009 | Erickson et al. | |
| 2009/0266433 | A1 | 10/2009 | Liang | |
| 2011/0289676 | A1 | 12/2011 | Lin | |
| 2012/0067437 | A1 | 3/2012 | Xia | |
| 2012/0085446 | A1 | 4/2012 | Lin | |
| 2013/0019974 | A1 | 1/2013 | Laera | |
| 2013/0174932 | A1 | 7/2013 | Hou | |
| 2013/0340162 | A1 | 12/2013 | Peel | |
| 2014/0015246 | A1 | 1/2014 | Erickson et al. | |
| 2014/0130250 | A1 | 5/2014 | Courtney et al. | |
| 2014/0261749 | A1 | 9/2014 | Chen | |
| 2015/0308088 | A1 | 10/2015 | Enlow et al. | |
| 2016/0069051 | A1 | 3/2016 | McHale et al. | |
| 2016/0102682 | A1 | 4/2016 | Gass et al. | |
| 2016/0215482 | A1 | 7/2016 | Fourman et al. | |
| 2016/0236212 | A1 | 8/2016 | Patton et al. | |
| 2016/0243621 | A1 | 8/2016 | Lucas et al. | |
| 2016/0280197 | A1 | 9/2016 | Mayr et al. | |
| 2016/0340879 | A1 | 11/2016 | Chen | |
| 2016/0348913 | A1 | 12/2016 | Ott et al. | |
| 2017/0065147 | A1 | 3/2017 | Boyer | |
| 2017/0159447 | A1 | 6/2017 | Clum et al. | |
| 2017/0182503 | A1 | 6/2017 | Moehring et al. | |
| 2017/0285670 | A1 | 10/2017 | Pirutin | |
| 2017/0350104 | A1 | 12/2017 | Clarke et al. | |
| 2017/0350516 | A1 | 12/2017 | Wang et al. | |
| 2017/0356173 | A1 | 12/2017 | Loberger et al. | |
| 2018/0030700 | A1 | 2/2018 | Zindler et al. | |
| 2018/0135280 | A1 | 5/2018 | Nagaiwa et al. | |
| 2018/0328010 | A1 | 11/2018 | Faiola | |
| 2019/0055721 | A1 | 2/2019 | Dieterle et al. | |
| 2019/0078305 | A1 | 3/2019 | Lin et al. | |
| 2019/0264825 | A1 | 8/2019 | Rosko et al. | |
| 2020/0048879 | A1 | 2/2020 | Hadfield et al. | |
| 2020/0208752 | A1 | 7/2020 | Rosko et al. | |

FOREIGN PATENT DOCUMENTS

| | | | |
|---|---|---|---|
| CN | 206052880 | | 3/2017 |
| CN | 206846029 | U | 1/2018 |
| EP | 1342855 | A1 | 9/2003 |
| GB | 2145499 | A | 3/1985 |
| JP | 06-010382 | A | 1/1994 |
| JP | 2005133481 | | 5/2005 |
| JP | 3204438 | | 6/2016 |
| JP | 3204438 | U | 6/2016 |
| KR | 200273548 | | 4/2002 |
| WO | WO2015/154170 | | 10/2015 |
| WO | 2016/185484 | A1 | 11/2016 |
| WO | WO2017/070232 | | 4/2017 |

OTHER PUBLICATIONS

Bill McKeone, How KALLISTA is Changing the Rules of Design with Metal Additive Manufacturing; retrieved on Mar. 7, 2018 from https://www.3dsystems.com/kallista-direct-metal-printed-faucets, 3 pgs.

Chicago Faucets, Angle Stop with Integral Check; retrieved on Mar. 7, 2018, 2 pgs.

* cited by examiner

CANTILEVERED FAUCET SPOUT

BACKGROUND AND SUMMARY OF THE DISCLOSURE

The present disclosure relates to faucets and, more particularly, to faucet spouts for discharging water. More particularly, the present disclosure relates to a faucet spout including spaced apart fluid channels that converge at a point near the outlet or outlets of a faucet assembly to create a desired flow pattern (e.g., waterfall flow).

Faucets including multiple passageways for the delivery of water to a spout outlet are known. In some faucets, a premixing chamber may exist where water from each valve is combined prior to being discharged from the spout outlet. In other faucets, water in the passageways may remain separated from each other and the outlet of each passageway may be located adjacent to each other.

Control over waterflow is a known performance factor for faucets. Aesthetic details and waterflow characteristics are also factors often considered in the design of faucets. With the recent availability of additive manufacturing (e.g., three-dimensional printing), new and useful designs can now be created than previously possible by traditional manufacturing processes.

In an illustrative embodiment of the present disclosure, a faucet assembly includes a spout having at least one outlet, a first fluid channel fluidly coupled to a water source and the at least one outlet, and a second fluid channel fluidly coupled to a water source and the at least one outlet. The faucet assembly further includes a mounting shank with an inlet capable of being fluidly coupled to the water source and connecting the first and second fluid channels to the water source. The first fluid channel and the second fluid channel are spaced apart to define an interior void along at least a portion of the spout.

According to another illustrative embodiment of the present disclosure, a faucet spout includes a fluid inlet, a base operably coupled to the fluid inlet, a first arm supported by the base and defining a first fluid channel fluidly coupled to the first inlet, and a second arm supported by the base and defining a second fluid channel fluidly coupled to the fluid inlet. The first arm and the second arm are spaced apart to define a first interior void therebetween. An outlet is in fluid communication with the first fluid channel and the second fluid channel.

According to a further illustrative embodiment of the present disclosure, a faucet spout includes a mounting shank having a fluid inlet configured to be fluidly coupled to a water source, and a spout body coupled to the mounting shank. The spout body includes at least one outlet, at least one fluid channel fluidly coupled to the fluid inlet of the mounting shank and the at least one outlet, and a flange positioned adjacent the outlet to provide a sheet-like effect to discharged fluid. The mounting shank extends along an axis parallel to the at least one fluid channel of the spout body.

According to another illustrative embodiment of the present disclosure, a faucet spout includes a fluid inlet, a base operably coupled to the fluid inlet, and a first arm supported by the base and defining a first fluid channel fluidly coupled to the fluid inlet. An outlet portion is coupled to the first arm and includes a discharge opening in fluid communication with the first fluid channel, and a flange cooperating with the discharge opening to produce a waterfall flow to fluid discharged from the discharge opening.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the disclosure described herein are not intended to be exhaustive or to limit the disclosure to the precise forms disclosed. Rather, the embodiments described herein enable one skilled in the art to practice the disclosure.

Figure 1:
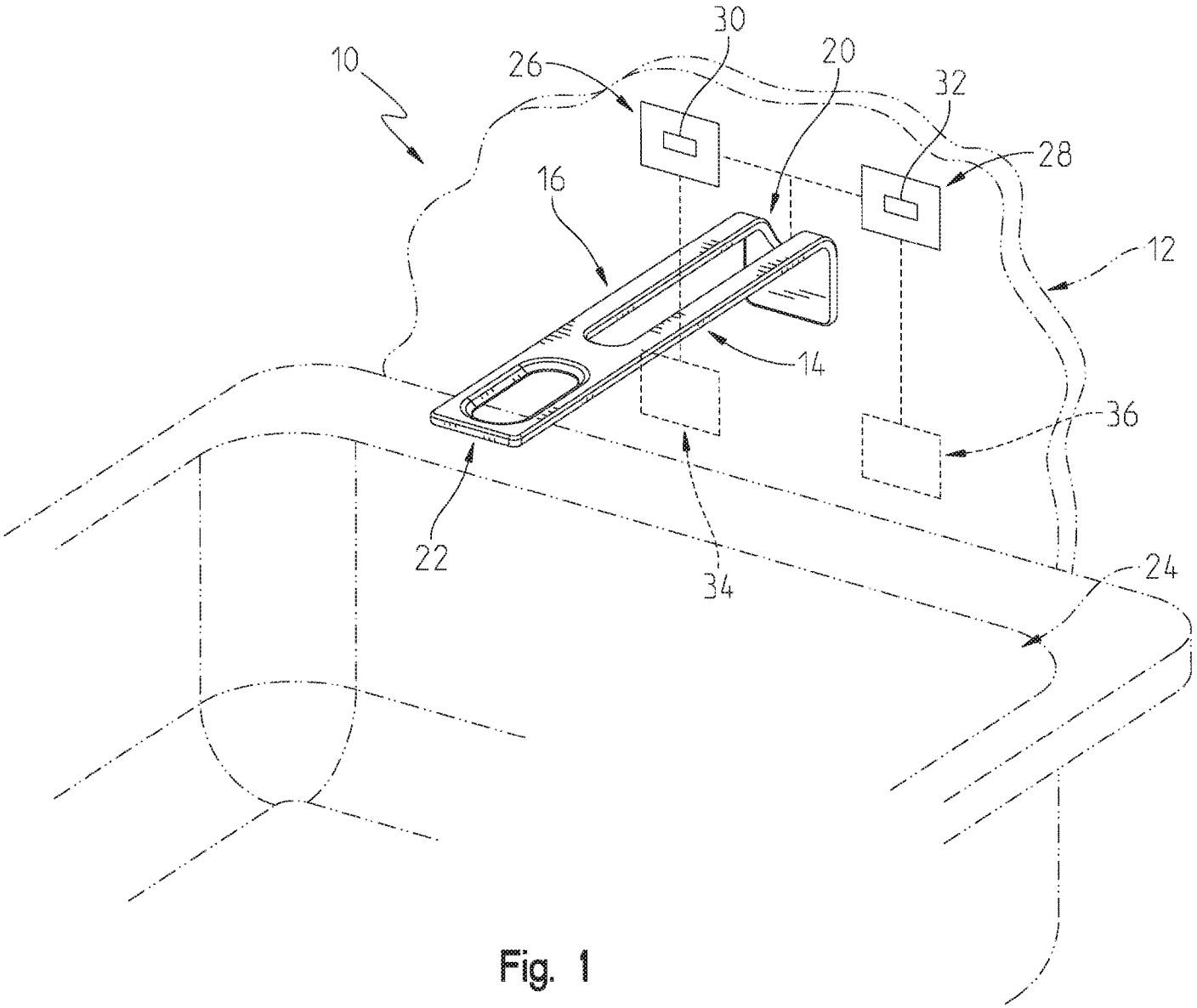
FIG. 1 is a perspective view of an illustrative faucet assembly of the present disclosure shown mounted to a vertical wall.
Figure 2:
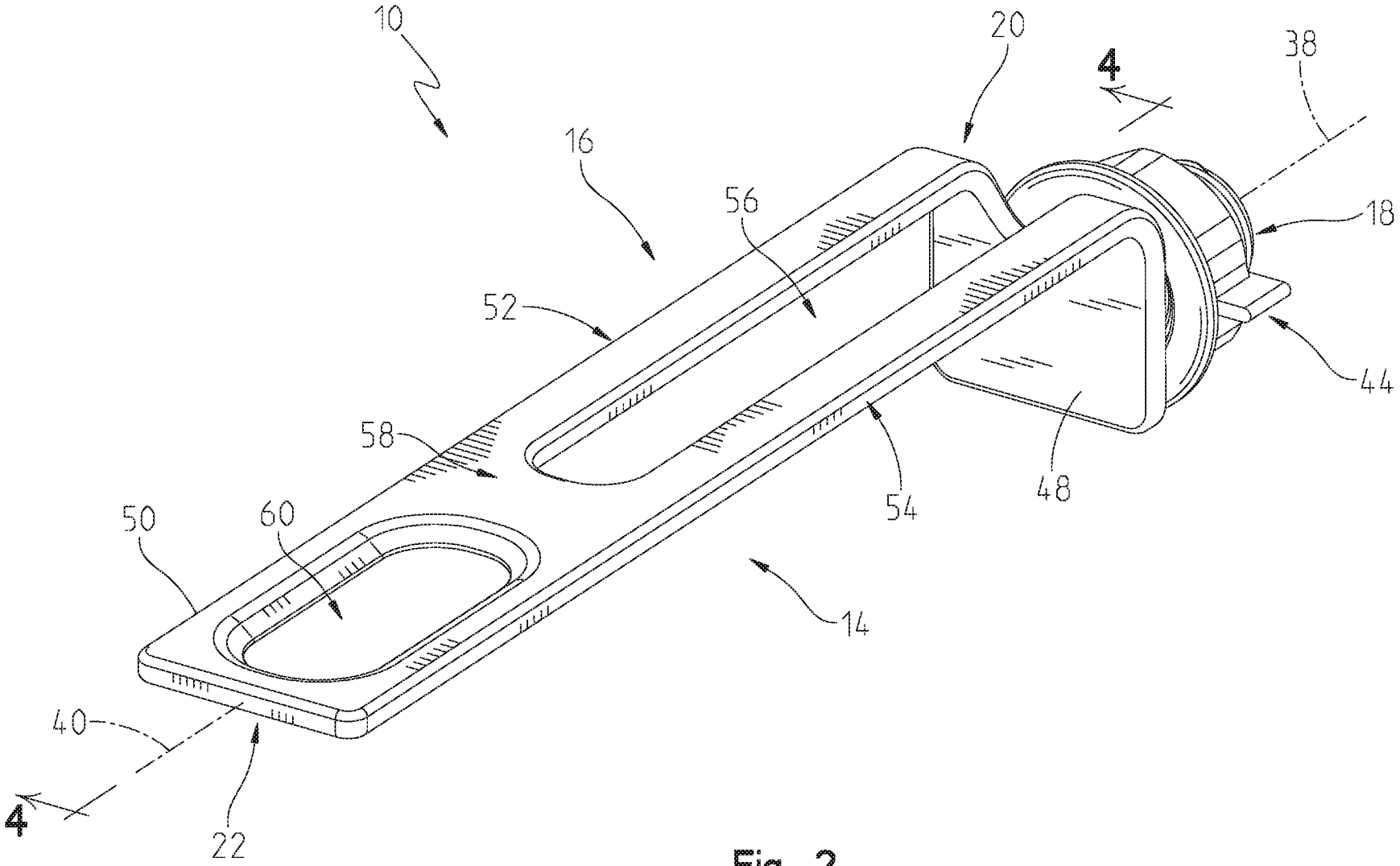
FIG. 2 is a top perspective view of a delivery spout of the faucet assembly of FIG. 1.

Referring initially to FIGS. 1 and 2, an illustrative faucet assembly 10 is shown coupled to mounting structure, illustratively a vertical support or wall 12. Faucet assembly 10 illustratively includes a faucet spout 14 including a spout body 16 and a mounting shank 18 (FIG. 2). When mounted, faucet spout 14 extends axially away from the wall 12 from a proximal end 20 to a distal end 22. The distal end 22 of the faucet spout 14 illustratively extends over a container 24, such as a basin, a tub, a sink, etc.

Illustratively, the faucet spout 14 is fluidly coupled to hot and cold water control valves 26 and 28, shown schematically in FIG. 1. The hot and cold water control valves 26 and 28 illustratively include handles 30 and 32, respectively, also shown schematically in FIG. 1. In one illustrative embodiment, hot water control valve 26 controls flow of hot water from a hot water source 34 in response to rotation of handle 30, while cold water control valve 28 controls flow of cold water from a cold water source 36 in response to rotation of handle 32. In other illustrative embodiments, control valves 26 and 28 may control other types of liquids including, for example, filtered or treated water. Further, in other illustrative embodiments, faucet assembly 10 may include only one handle to control valves 26 and 28, or faucet assembly 10 may include only one valve (e.g., a mixing valve). In yet other illustrative embodiments, the manual water control valves 26 and 28 may be replaced with one or more electrically operable valves.

Figure 3:
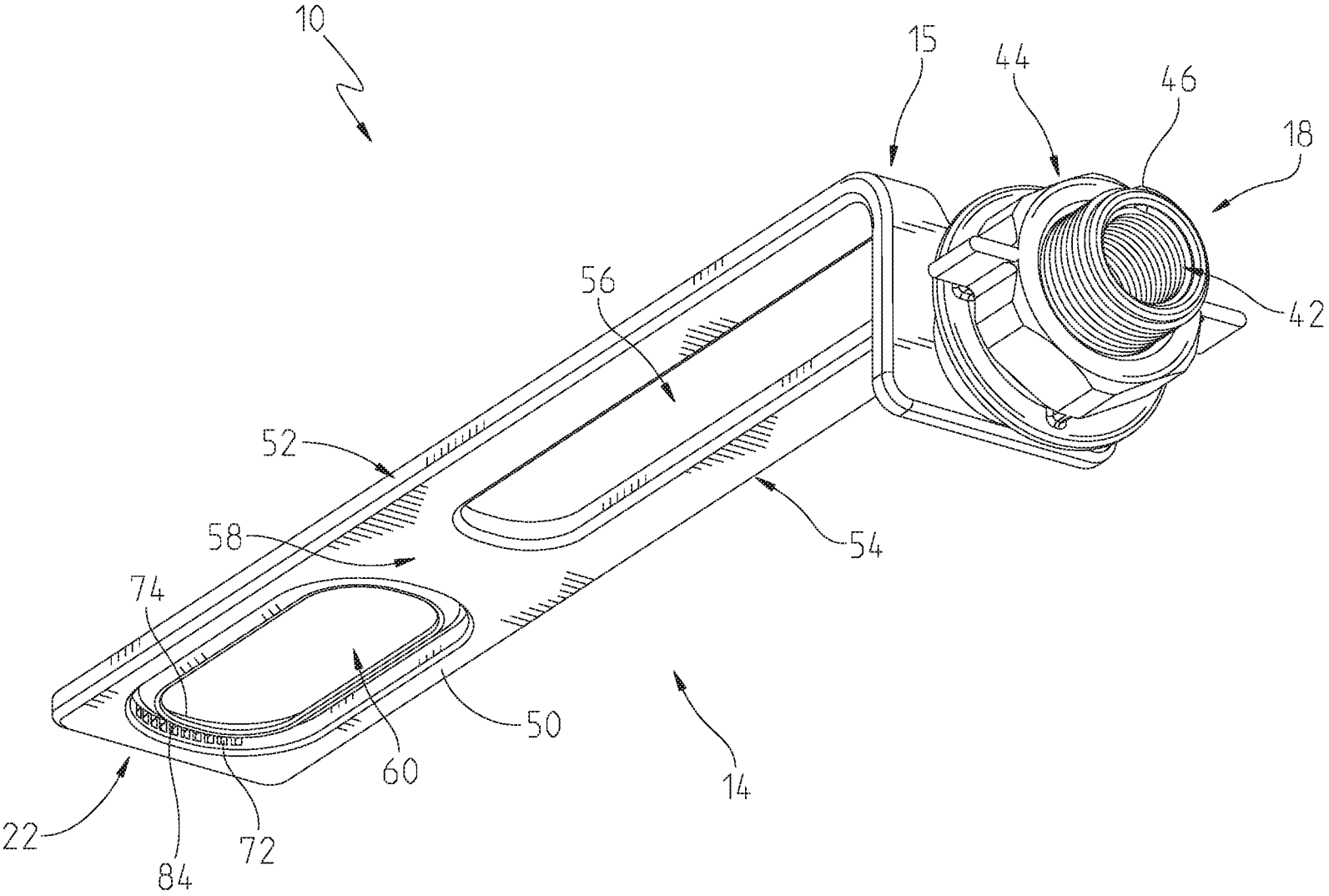
FIG. 3 is a bottom perspective view of the delivery spout of FIG. 2.
Figure 4:
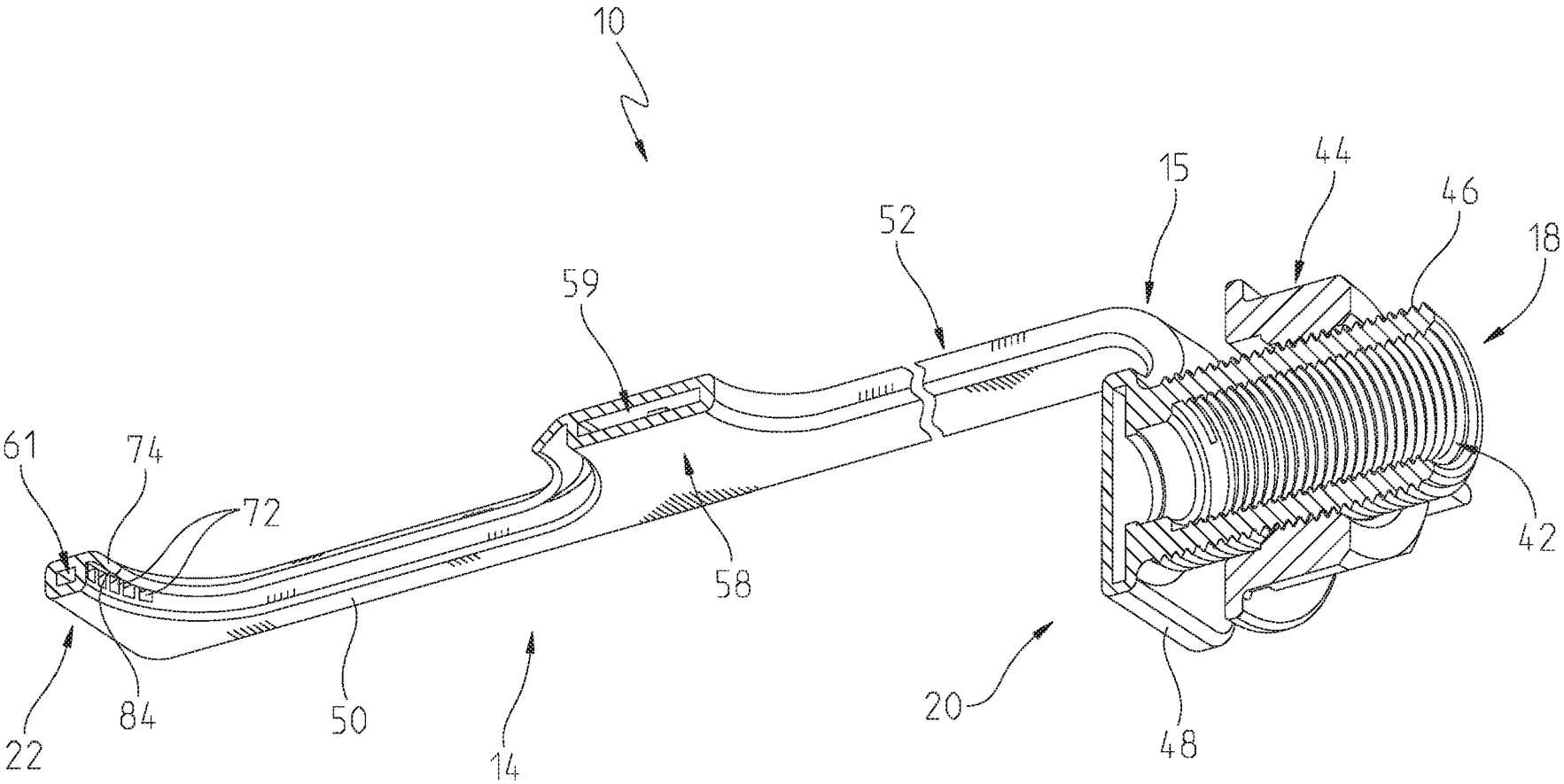
FIG. 4 is a bottom perspective view of the delivery spout of FIG. 2, show in cross-section taken along line 4-4 of FIG. 2.

With reference to FIGS. 2-4, the illustrative faucet assembly 10 is capable of being coupled to the mounting structure 12 (FIG. 1) through the mounting shank 18. In an illustrative embodiment, the mounting shank 18 extends away from the faucet spout 14 along an axis 38 parallel to an axis 40 of the faucet spout 14. In another illustrative embodiment, the mounting shank 18 may extend along an axis that is not parallel to the axis 40 of the faucet spout 14. When mounted, the mounting shank 18 penetrates mounting structure 12 (FIG. 1) and is fluidly coupled to valves 26 and 28 (FIG. 1) via a shank inlet 42. Mounting shank 18 is secured to mounting structure 12 (FIG. 1) via mounting nut 44 engaging external threads 46 of mounting shank 18. Illustratively, the wall 12 is clamped between the spout 14 and the mounting nut 44.

Figure 7:
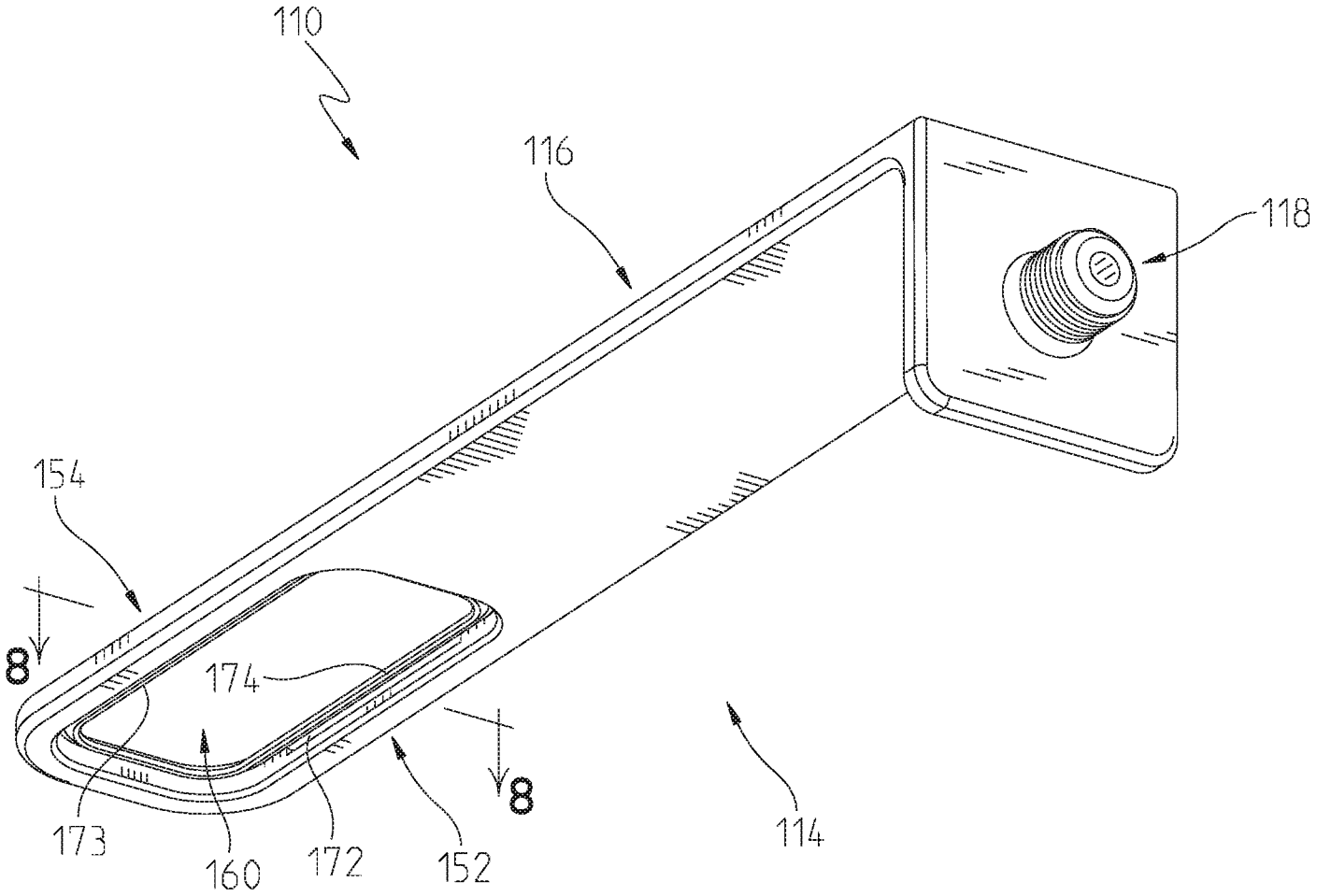
FIG. 7 is a bottom perspective view of a further illustrative delivery spout of the present disclosure.
Figure 8:
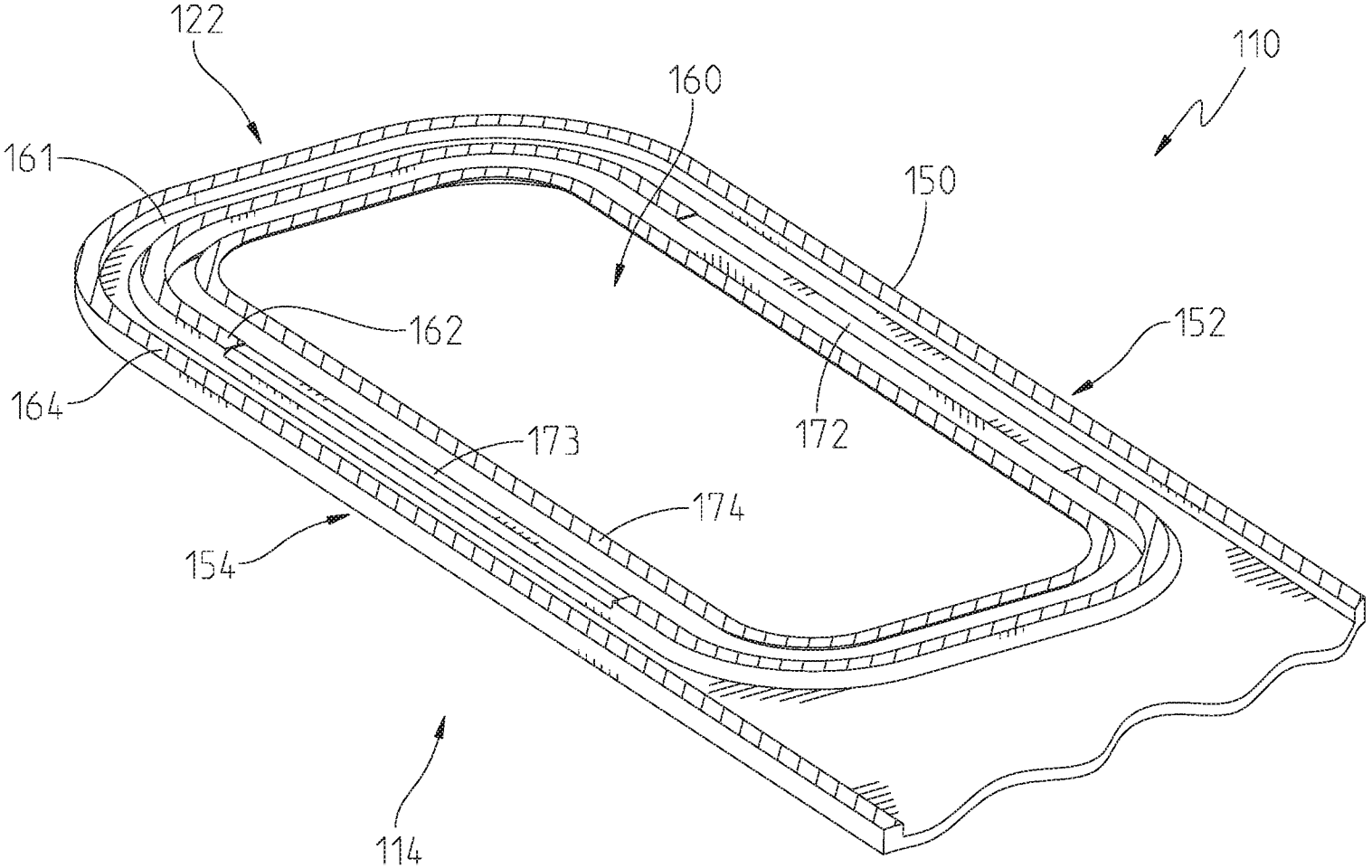
FIG. 8 is a cross-sectional view in cross-section of the delivery spout of FIG. 7 taken along line 8-8.

Still referring to FIGS. 2-4, the illustrative faucet spout 14 includes a body 16 extending axially between a proximal end 20 and a distal end 22. The body 16 illustratively includes a base 48 at the proximal end 20, and an outlet portion 50 at the distal end 22. Axially extending first and second arms 52 and 54 are supported by the base 48 and define first and second fluid channels 53 and 55. Illustratively, the fluid channels 53 and 55 are fluidly coupled to the control valves 26 and 28 (FIG. 1) via mounting shank 18. In an illustrative embodiment, the first and second arms 52 and 54 are spaced apart from one another by a body void or body opening 56 for at least a partial length of faucet spout 14. The first and second arms 52 and 54 may converge at a bridge 58 defining a bridge channel 59. Illustratively, the bridge channel 59 is in fluid communication with the first and second fluid channels 53 and 55. In alternate embodiments, the faucet spout 14 may not include body opening 56 and/or bridge 58, as shown in FIGS. 7 and 8.

After converging at bridge 58, fluid channels 53 and 55 may define an outlet portion 50 including a dispensing void or dispensing opening 60, and converging again via a dispensing channel 61 at distal end 22 of faucet spout 14. The dispensing channel 61 is defined by an inner wall 62 and a peripheral outer wall 64. The bridge 58 illustratively includes opposing lateral walls 66 and 68 defining a connecting opening 70 providing fluid communication between the bridge channel 59 and the dispensing channel 61.

Referring further to FIGS. 3 and 4, outlet ports or openings 72 allow for the dispensing of water or other liquid from dispensing channel 61. A flange or lip 74 is supported by the inner wall 62 and positioned inwardly from the openings 72. In an illustrative embodiment, frontal interior portion of the flange or lip 74 of distal end 22 of faucet spout 14 results in the downward force of the water or other liquid dispensed from the openings 72, resulting in a waterfall effect when the flow of water or other liquid is operational.

Figure 5:
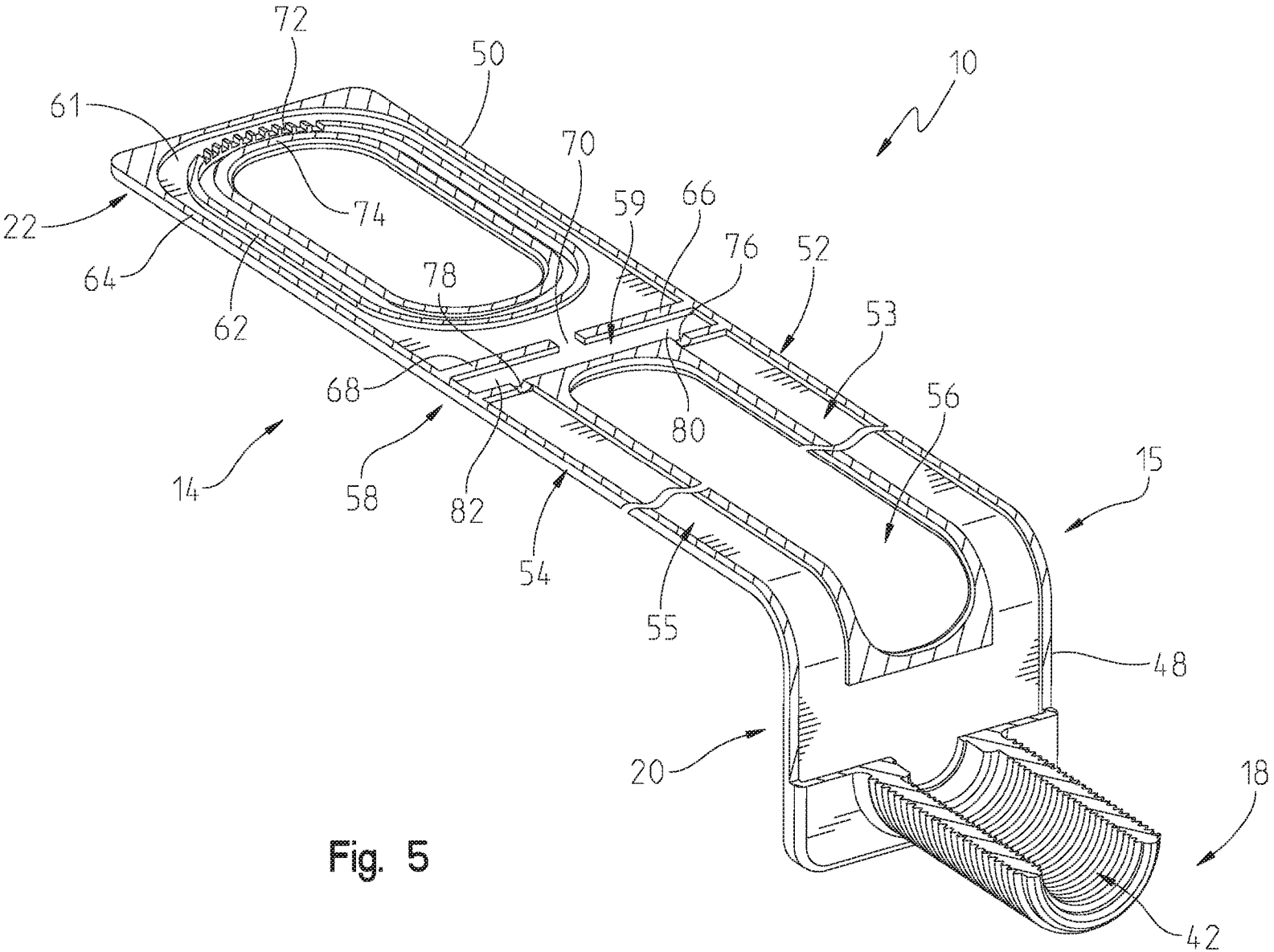
FIG. 5 is a top perspective view of the delivery spout of FIG. 2, shown in partial cross-section.

With reference to FIG. 5, the interior structure of the illustrative outlet portion 50 of the faucet assembly 10 is shown in greater detail. Water or other liquid from the water source enters mounting shank 18 via shank inlet 42, which is fluidly coupled to valves 26 and 28 (FIG. 1). The pressure from the flow of water pushes the water into the interior of faucet spout 14 and into fluid channels 53 and 55 around body opening 56. Water then enters bridge channel 59 via bridge ports 76 and 78, and rejoin at dispensing channel 61 via the connecting opening 70. Illustratively, the ports 76 and 78 can restrict fluid flow and/or remove turbulence. Serpentine paths 80 and 82 from the ports 76 and 78 to the opening 50 as defined by the walls 66 and 68 may also remove turbulence from the fluid as it flows to the dispensing channel 61.

Figure 6:
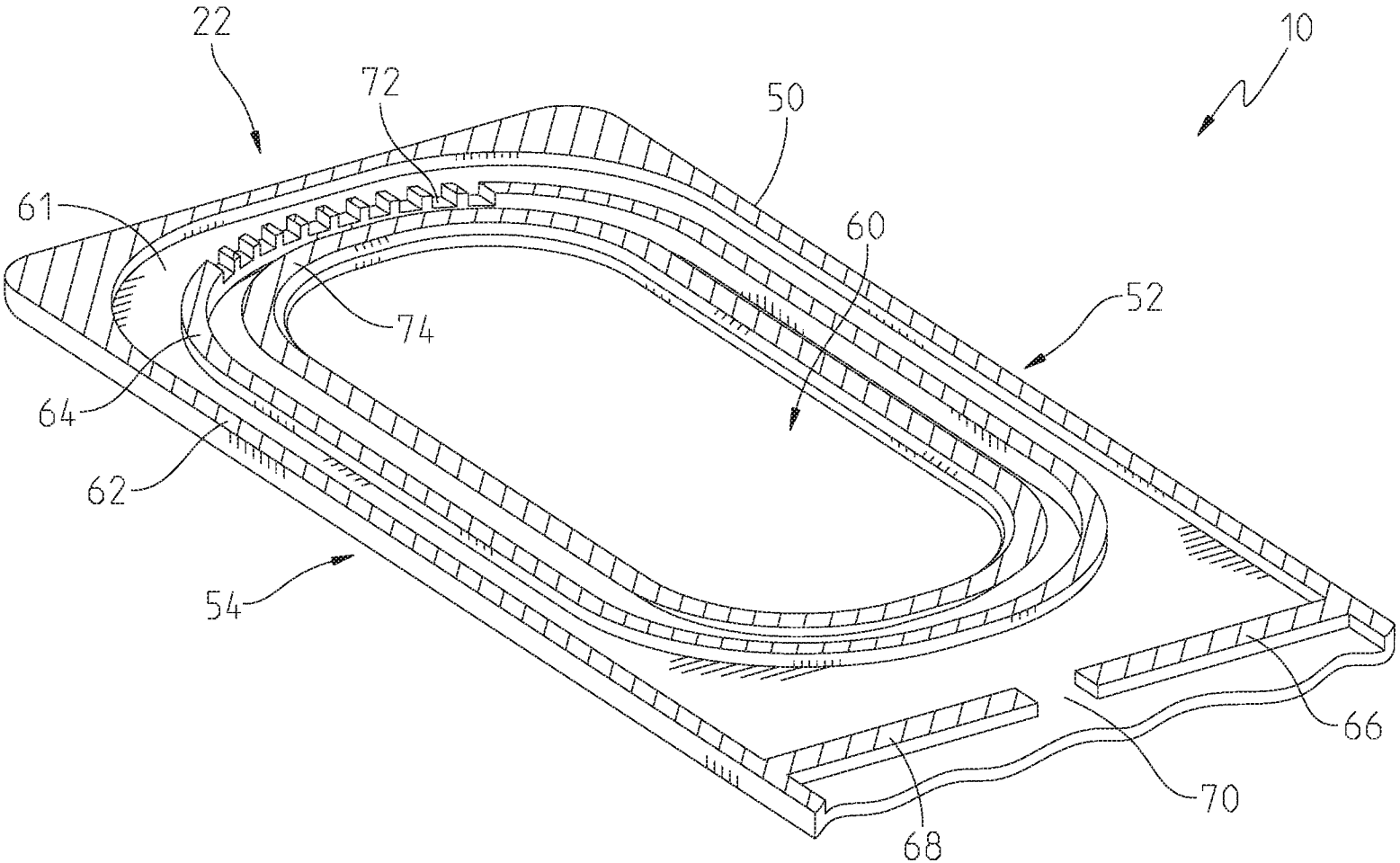
FIG. 6 is a detailed view in longitudinal cross-section of the outlet portion of the delivery spout of FIG. 5.

Referring further to FIGS. 5 and 6, when the water flow reaches dispensing channel 61, the pressure of the water flow pushes the water out of outlet ports 72. The force of the water flow exiting outlet ports causes the water to hit frontal interior portion 84 of lip 74 (FIG. 3) and, as a result, fall substantially uniformly in a waterfall pattern. In alternate embodiments, a conventional aerator or stream straightener could be utilized with faucet assembly 10 rather than outlet ports 72.

Referring to FIG. 7, in another illustrative embodiment, faucet assembly 110 is shown. Faucet assembly 110 includes faucet spout 114 and mounting shank 118. In an illustrative embodiment, faucet spout 114 includes fluid channels 152 and 154 fluidly coupled to a water source via mounting shank 118 and faucet spout body 116. Fluid channels 152 and 154 may define a dispensing void or dispensing opening 160. In an illustrative embodiment, outlet ports 172 and 173 are arranged laterally along the interior edge of dispensing opening 160. Outlet ports 172 and 173 comprise of angled openings to allow for water or other liquid to flow from the interior of faucet spout 114.

With reference to FIG. 8, a cross-section of dispensing opening 160 and fluid channels 152 and 154 is shown along line 8-8 (FIG. 7). Fluid channels 152 and 154 converge via dispensing channel 161 at distal end 122 of dispensing spout 114. When the valves (not shown) of faucet assembly 110 are operational, the pressure resulting from the water flow pushes the water out of outlet ports 172 and 173, creating a laterally spaced mirrored waterfall pattern within dispensing opening 160. As a result, the water flow from outlet port 172 mixes with the water flow from outlet port 173 at a point below dispensing opening 160. The point at which the water flow from outlet port 172 and the water flow from outlet port 173 mix may be altered depending on the angle used to form each outlet port.

Illustratively, faucet assemblies 10 and 110 are formed as one continuous piece using additive manufacturing processes, such as three dimensional (3D) printing. In other illustrative embodiments, various components of the faucet assemblies 10 and 110 may be formed as separate parts via known manufacturing processes and secured together using various known fastening means (such as adhesives, threaded couplings, etc.). For example, three-dimensional printing illustratively uses digital three dimensional models (such as those created from scans or computer-assisted design software) to produce a three dimensional object through the creation of layers by a three dimensional printer. Several different three dimensional printing technologies are known, including selective laser sintering, fused deposition modeling, direct metal laser sintering, electron beam additive manufacturing technology, and stereolithography.

Many different materials can be used to create three dimensionally printed objects, including acrylonitrile butadiene styrene plastic, polylactic acid, polyamide, glass filled polyamide, epoxy resins, silver, titanium, steel, wax, photopolymers, polycarbonate, stainless steels, INCONEL, brass, bronze, and other materials that may be powder based. Where direct metal laser sintering is used with application-suitable corrosion resistant materials, non-sintered metallic powder can be removed with a stream of pressurized fluid, and internal channels treated with acid etching or abrasive slurries. Multimedia three dimensional printing is also known, so that in some embodiments, mixed metallic-plastic items may be fabricated.

Although the invention has been described in detail with reference to certain preferred embodiments, variations and modifications exist within the spirit and scope of the invention as described and defined in the following claims.

What is claimed is:

1. A faucet spout comprising:

a fluid inlet;

a base operably coupled to the fluid inlet;

a first arm supported by the base and defining a first fluid channel fluidly coupled to the fluid inlet;

a second arm supported by the base and defining a second fluid channel fluidly coupled to the fluid inlet, wherein the first arm and the second arm are spaced apart to define a first interior void therebetween and a second interior void therebetween;

a bridge extending between the first arm and the second arm so that the bridge separates the first interior void proximally of the bridge and the second interior void distally of the bridge, the bridge defining a bridge channel fluidly coupled to the first fluid channel and the second fluid channel; and an outlet in fluid communication with the first fluid channel and the second fluid channel.

2. The faucet spout of claim 1, further comprising a mounting shank defining the fluid inlet and configured to be fluidly coupled to a water source.

3. The faucet spout of claim 2, wherein the mounting shank extends parallel to the first arm and the second arm.

4. The faucet spout of claim 1, further comprising a flange positioned outwardly from and adjacent to the outlet to provide a sheet-like effect to discharged fluid.

5. The faucet spout of claim 4, wherein the outlet includes a plurality of openings positioned facing the second interior void opposite the bridge.

6. The faucet spout of claim 5, wherein the flange cooperates with the plurality of openings to produce a waterfall flow to fluid discharged from the outlet.

7. The faucet spout of claim 4, wherein the outlet includes a first opening positioned laterally of the second interior void and a second opening positioned laterally of the second interior void in spaced relation to the first opening.

8. The faucet spout of claim 7, wherein the flange and the first opening are configured to produce a first waterfall flow, and the flange and the second opening is configured to produce a second waterfall flow.

9. The faucet spout of claim 1, wherein the base, the first arm and the second arm are formed via an additive manufacturing process.

10. A faucet spout comprising:

a mounting shank including a fluid inlet configured to be fluidly coupled to a water source; and a spout body coupled to the mounting shank, the spout body including:

at least one outlet;

at least one fluid channel fluidly coupled to the fluid inlet of the mounting shank and the at least one outlet; and a flange positioned adjacent the outlet to provide a sheet-like effect to discharged fluid;

wherein the mounting shank extends along an axis parallel to the at least one fluid channel of the spout body;

wherein the spout is substantially perpendicular to a mounting structure when secured to the mounting structure by the mounting shank;

wherein the at least one fluid channel includes a first fluid channel fluidly coupled to the inlet of the mounting shank and the at least one outlet and a second fluid channel fluidly coupled to the inlet of the mounting shank and the at least one outlet;

wherein the first fluid channel and the second fluid channel are spaced apart to define an interior void along at least a portion of the spout.

11. The faucet spout of claim 10, wherein the outlet includes a plurality of openings positioned along an inside of the interior void of the spout opposite the position of the mounting shank.

12. The faucet spout of claim 11, wherein the flange cooperates with the plurality of openings to produce a waterfall flow to fluid discharged from the outlet.

13. The faucet spout of claim 10, wherein the spout body is formed via an additive manufacturing process.

14. A faucet spout comprising:

a fluid inlet;

a base operably coupled to the fluid inlet;

a first arm supported by the base and defining a first fluid channel fluidly coupled to the fluid inlet;

an outlet portion coupled to the first arm and including a discharge opening in fluid communication with the first fluid channel, and a flange cooperating with the discharge opening to produce a waterfall flow to fluid discharged from the discharge opening, wherein the flange laterally extends downstream of the discharge opening; and wherein the outlet portion includes a vertically extending distal void, and a discharge channel surrounding the distal void, wherein the discharge opening is in fluid communication with the discharge channel and the distal void.

15. The faucet spout of claim 14, further comprising a second arm defining a second fluid channel fluidly coupled to the inlet of the base, wherein the first arm and the second arm are spaced apart to define a proximal void.

16. The faucet spout of claim 15, further comprising a bridge defining a bridge channel, the bridge channel fluidly coupled to the first fluid channel and the second fluid channel.

17. The faucet spout of claim 16, wherein the proximal void is positioned proximally of the bridge, and the distal void is positioned distally of the bridge.

18. A faucet spout comprising:

a fluid inlet;

a base operably coupled to the fluid inlet;

a first arm supported by the base and defining a first fluid channel fluidly coupled to the fluid inlet;

an outlet portion coupled to the first arm and including a discharge opening in fluid communication with the first fluid channel, and a flange cooperating with the discharge opening to produce a waterfall flow to fluid discharged from the discharge opening, wherein the flange laterally extends downstream of the discharge opening;

a second arm spaced apart from the first arm; and a mounting shank defining the fluid inlet and configured to be fluidly coupled to a water source, wherein the mounting shank extends parallel to the first arm and the second arm.

19. The faucet spout of claim 14, wherein the base, the first arm, and the outlet portion are formed via an additive manufacturing process.

20. The faucet spout of claim 10, wherein the interior void is defined by a vertically extending distal void.

21. A faucet spout comprising:

a fluid inlet;

a base operably coupled to the fluid inlet;

a first arm supported by the base and defining a first fluid channel fluidly coupled to the fluid inlet;

an outlet portion coupled to the first arm and including a discharge opening in fluid communication with the first fluid channel;

wherein the outlet portion includes a vertically extending distal void and a discharge channel in fluid communication with the first fluid channel and the discharge opening; and wherein the outlet portion includes a flange positioned inwardly from the discharge opening in a direction toward the center of the vertically extending distal void.

22. The faucet spout of claim 21, further comprising a second arm defining a second fluid channel fluidly coupled to the inlet of the base, wherein the first arm and the second arm are spaced apart to define a proximal void.

23. The faucet spout of claim 22, further comprising a bridge defining a bridge channel, the bridge channel fluidly coupled to the first fluid channel and the second fluid channel.

24. The faucet spout of claim 23, wherein the proximal void is positioned proximally of the bridge, and the distal void is positioned distally of the bridge.

25. The faucet spout of claim 21, further comprising a mounting shank defining the fluid inlet and configured to be fluidly coupled to a water source, wherein the mounting shank extends parallel to the first arm.

* * * * *